United States Patent [19]

Stapp

[11] Patent Number: 4,541,918

[45] Date of Patent: Sep. 17, 1985

[54] DEARSENATING OF SHALE OIL WITH POLYACRYLAMIDES

[75] Inventor: Paul R. Stapp, Bartlesville, Okla.

[73] Assignee: Phillips Petroleum Company, Bartlesville, Okla.

[21] Appl. No.: 671,648

[22] Filed: Nov. 15, 1984

[51] Int. Cl.[4] ..... C10G 21/06; C10G 21/00

[52] U.S. Cl. ..... 208/87; 208/49; 208/88; 208/211; 208/251 R

[58] Field of Search ..... 208/251 R, 309, 49, 208/88, 87, 91

[56] References Cited

U.S. PATENT DOCUMENTS

| | | | |
|---|---|---|---|
| 3,200,106 | 8/1965 | Dickson et al. | 208/251 R |
| 3,542,669 | 11/1970 | DeFeo | 208/91 |
| 4,159,241 | 6/1979 | Simo | 208/251 H |
| 4,272,362 | 6/1981 | Schneider et al. | 208/87 |

OTHER PUBLICATIONS

Encyclopedia of Polymer Science and Technology, vol. 1, 1964, John Wiley and Sons, Inc., pp. 177–194.

*Primary Examiner*—D. E. Gantz
*Assistant Examiner*—Chung K. Pak
*Attorney, Agent, or Firm*—K. K. Brandes

[57] ABSTRACT

Arsenic impurities are removed from a hydrocarbon-containing feed stream, preferably shale oil, by contacting it with an aqueous solution of a polyacrylamide.

21 Claims, No Drawings

DEARSENATING OF SHALE OIL WITH POLYACRYLAMIDES

BACKGROUND OF THE INVENTION

This invention relates to the purification of hydrocarbon-containing feed streams which contain undesirable contaminants. In accordance with another aspect, this invention relates to the extraction of hydrocarbon-containing feed streams to remove therefrom arsenic impurities. In another aspect, this invention relates to the use of aqueous, polymer-containing extractants for the removal of arsenic contaminants from various hydrocarbon-containing feed streams, particularly shale oil.

There is an ever present need for the treatment of various hydrocarbon feed streams such as shale oil to remove undesirable components such as arsenic compounds therefrom. The removal of these impurities improves the processability of these hydrocarbon streams in subsequent operations, e.g., those employing catalysts that are easily deactivated by arsenic compounds. If As compounds are not substantially removed prior to operations such as catalytic hydrotreating, hydrocracking and cracking, arsenic is deposited on these catalysts and the catalyst life is shortened.

SUMMARY OF THE INVENTION

It is an object of this invention to provide a process for the purification of hydrocarbon-containing feed streams, which contain arsenic impurities. It is another object of this invention to provide a process for removing arsenic-containing compounds from hydrocarbon-containing feed streams, particularly shale oil, by extraction with an aqueous extractant. It is a further object of this invention to produce a hydrocarbon-containing stream having a reduced level of arsenic. It is still another object of this invention to improve the processability of hydrocarbon-containing streams by reducing their arsenic levels. It is a still further objective of this invention to improve the compatibility of shale oil having reduced arsenic content with other hydrocarbon-containing feed streams such as petroleum-derived feed streams so that the two streams can be blended and further treated, such as by hydrotreatment, catalytic cracking and the like. Other objects and advantages will be apparent from the detailed description and the appended claims.

In accordance with the instant invention, a hydrocarbon-containing feed stream, which also contains small amounts of arsenic compounds as impurities, is contacted with an aqueous extractant medium containing at least one substantially dissolved polyacrylamide. The hydrocarbon feed stream and the aqueous extractant are substantially immiscible. The dissolved polyarylamide functions as an agent for binding arsenic compounds at a relatively low temperature such as room temperature. Removal of arsenic compounds thereof from a hydrocarbon-containing stream, particularly shale oil, provides for improved processability, either alone or when blended with at least one petroleum-derived hydrocarbon stream, in subsequent processes such as hydrodesulfurization, hydrogenation and catalytic cracking.

DETAILED DESCRIPTION OF THE INVENTION

Any hydrocarbon-containing feed stream, which contains arsenic compounds, can be treated in accordance with the process of this invention. Suitable feed streams are crude oils, crude oil fractions, petroleum products, coal pyrolyzates, products from the extraction and/or liquefaction of coal and lignite, products from tar sands and, most particularly, shale oils and products or fractions of shale oil. The term "shale oil" is used hereinafter for hydrocarbon-containing materials produced by pyrolysis, hydroretorting and/or extraction of kerogen-containing materials such as oil shale. Raw shale oil, the preferred hydrocarbon-containing feed stream of this invention, generally contains about 1–200, more particularly about 5–100, ppmw (parts per million by weight) arsenic; about 0.1–3, more particularly about 0.2–2, weight percent sulfur; about 0.2–5, more particularly about 0.3–3, weight percent total nitrogen; about 5–300, more particularly about 10–200, ppmw metals, mainly iron, nickel and vanadium. The API gravity of the shale oil feed generally ranges from about 5 to about 50, probably from about 15 to about 35. The shale oil can be derived by any known process (e.g., retorting, hydroretorting, extracting and the like) from a kerogen-containing mineral such as oil shale. It is within the scope of this invention to use any fraction or product of shale oil, e.g., a fraction which boils at above 400° F., and to use pretreated shale oil.

Arsenic impurities contained in the hydrocarbon-containing feed streams can be inorganic arsenic compounds such as arsenic oxides, arsenic sulfides, metal arsenides, arsenous and arsenic acids, metal arsenites and arsenates, metal thioarsenites and thioarsenates; and organic arsenic compounds such as alkyl-, cycloalkyl and aryl-substituted arsines (e.g., tris(4-methylphenyl)arsine), arsolanes, arsoles, arsanes, arsenins, arsepanes, diarsocanes, arsonanes, arsenomethane, alkyl-, cycloalkyl- and aryl-substituted arsenic halides, hydroxyarsines, oxybis(secondary arsines), alkyl- or phenylarsine oxides, arsinic acids, arsonic acids, oxoarsines, arsenite and arsenate esters and the like, as described in Comprehensive Inorganic Chemistry, by J. C. Bailor et al., Pergamon Press, 1973, Volume 2, pages 547–683. Specific arsenic compounds contained in shale oils include methylarsonic acid, phenylarsonic acid, dimethylarsinic acid, and sodium arsenate.

The hydrocarbon-containing feed stream, which contains arsenic compounds, is contacted with an aqueous medium containing a substantially dissolved polyacrylamide so as to extract at least a portion of the arsenic impurities from the hydrocarbon stream. Any acrylamide homo- or copolymer, which is at least partially soluble in water and which is capable of binding arsenic compounds, is suitable for the practice of this invention. Examples of suitable acrylamide polymers are disclosed in Encyclopedia of Polymer Science and Technology, Volume 1, 1964, Interscience Publishers (a division of John Wiley and Sons, Inc), pages 177–194, herein incorporated by reference. Water-soluble acrylamide homopolymers are those prepared by addition polymerization of monomers having the generic formula $CH_2{=}CRCONR'R''$, wherein R, R' and R'' are independently selected from the group consisting of H, alkyl and hydroxyalkyl groups having 1–4 carbon atoms. Examples of suitable acrylamide homopolymers are polyacrylamide $[{-}CH_2{-}CH(CONH_2){-}]_n$, poly(N-methylacrylamide), poly(N-methylolacrylamide), poly(N-isopropylacrylamide), poly(N,N-dimethylacrylamide), poly(N,N-diisopropylacrylamide), poly(N,N-methyl-n-butylacrylamide), polymethacrylamide, poly(N-methylmethacrylamide). These polyacrylamides can can optionally be converted to anionic derivatives by partial hydrolysis or sulfomethylation or Hofman degradation.

Water-soluble acrylamide copolymers and cationic derivatives thereof are those prepared by polymerization of $CH_2=CRCONR'R''$ plus at least one other suitable monomer such as acrylic acid, sodium acrylate, methacrylic acid, sodium methacrylate, methyl acrylate, methyl methacrylate, acrylonitrile, vinylpyridine, vinylbenzylammonium compounds, and diallylammonium compounds.

The presently preferred polyacrylamides are unsubstituted acrylamide homopolymers, more preferably polyacrylamide, having a molecular weight ranging from about $1\times10^3$ to about $1\times10^8$, more preferably $2\times10^6$ to $2\times10^7$, and having a degree hydrolysis (i.e., the percentage of CONR'R'' groups converted to COOH or $COO^-$ groups) ranging from 0% to about 50%, more preferably from about 10% to about 40%.

The total concentration of polyacrylamides substantially dissolved or in the aqueous extractant can range from about 5 to about 5000 ppmw (parts by million by weight), preferably from about 10 to about 2000 ppmw. The weight ratio of substantially dissolved polyacrylamide to the hydrocarbon-containing feed stream in the extraction process generally ranges from about 0.05:1 to about 20:1, and preferably is in the range of about 0.1:1 to about 2:1.

The dearsenating process of this invention can be carried out by means of any apparatus, whereby there is achieved an intimate contact of the aqueous, polyacrylamide-containing extractant with the hydrocarbon-containing feed stream, under suitable dearsenating conditions. The process is in no way limited to the use of a particular apparatus. The process can be carried out as a continuous operation or as a batch process. The terms hydrocarbon-containing feed stream and hydrocarbon stream (or hydrocarbon material) are used herein to refer to both continuous and batch processes.

The hydrocarbon-containing feed stream and the aqueous extractant can be introduced into a reactor in any suitable manner. The hydrocarbon stream and the aqeous extractant can be introduced essentially simultaneously into the reactor and then mixed in the reactor so as to afford intimate contact between the two substantially immiscible phases so as to form a two-phase liquid mixture. The mixing can be accomplished by mechanical agitation or by passage through static mixing devices such as baffle plates installed in the reactor. The hydrocarbon feed stream and water can also be premixed in a separate mechanical mixing vessel or in a vessel with circulating pumping action, or in a static mixing device, and then fed as one substantially premixed liquid stream into the reactor so as to produce a hydrocarbon effluent material having a reduced As content. In batch processes, the hydrocarbon feed stream and the aqueous extractant can be added to the reactor sequentially in any order before or while being agitated. Countercurrent extraction of the hydrocarbon-containing feed stream with the aqueous polyacrylamide-containing extractant can also be employed, and is a preferred mode in continuous operations.

Any suitable reaction time, i.e., time of intimate contact between the aqueous extractant containing at least one substantially dissolved polyacrylamide and the hydrocarbon-containing feed stream can be utilized. In general, the reaction time will range from about 0.05 hours to about 50 hours. Preferably, the reaction time will range from about 0.1 to about 5 hours. Thus, the flow rate of the hydrocarbon-containing feed stream should be such that the time required for the passage of the mixture through the reactor (residence time) will preferably be in the range of about 0.1 to 5 hours. One can, at any time during the process, monitor the arsenic content in the hydrocarbon raffinate stream, and determine when no more appreciable amount of arsenic is removed from the hydrocarbon stream and when the extraction should be ceased. Thereby the process of this invention can be controlled and automatized.

The demetallization process of the present invention can be carried out at any suitable temperature. The temperature will generally be in the range of about 10° C. to about 200° C. and will preferably be in the range of about 20° C. to about 90° C. Temperatures higher than 200° C. are generally not utilized since they may have adverse effects upon the stability of the aqueous polymer solution. Also, economic considerations are generally taken into account in the selection of the optimal operating temperature.

Any suitable pressure can be utilized in the demetallization process. The reaction pressure will generally be in the range of about atmospheric pressure (0 psig) to about 500 psig. Preferably, the pressure will be in the range of about 0 to about 100 psig, depending on the operating temperature.

After a substantial removal of arsenic from the hydrocarbon-containing feed stream is achieved by the intimate contact and extraction with an aqueous extractant, which contains at least one substantially dissolved polyacrylamide, the hydrocarbon-containing stream (first phase) having a reduced arsenic content and the aqueous extractant (second phase) now containing arsenic are generally separated. Any suitable liquid-liquid separation technique can be employed such as centrifugation and settling plus subsequent draining or pumping of the lighter phase and/or the heavier phase. Decantation or draining technique is presently preferred.

If the dearsenating process of this invention is carried out in a refinery where hydrodesulfurization and/or hydrodenitrogenation is practiced, the dearsenating process and the separation process are generally employed before the hydrodesulfurization and/or hydrodenitrogenation steps. It is presently preferred to carry out the dearsenating process of this invention first and thereafter desulfurize and denitrogenate the hydrocarbon products having a reduced arsenic level by a catalytic hydrotreating process, which generally removes more arsenic, plus metals, sulfur, nitrogen and carbon precursors.

A hydrocarbon stream, preferably shale oil, which is at least partially dearsenated in accordance with this invention and then separated from the aqueous extractant by conventional liquid-liquid separating means outlined above, can be blended with another suitable hydrocarbon stream such as crude oil, topped crude, resid, coal pyrolyzate, coal extract, tar sand extract and the like. Subsequently the entire blend can be treated in one or more hydrodemetallization, hydrodesulfurization, hydrodenitrogenation and cracking processes.

The at least partially dearsenated hydrocarbon material, preferably at least partially dearsenated shale oil, can also be fed directly to a cracking unit, e.g., a fluidized catalytic cracker, where it is converted to gasoline and other useful fuel products. The at least partially dearsenated hydrocarbon material can also first be demetallized and/or desulfurized and/or denitrogenated as outlined above, optionally as a blend with at least one other hydrocarbon containing stream (e.g., a petroleum-derived material), and then be charged to a cracking unit where it is heated under cracking conditions so as to produce gasoline and other useful fuel products.

The following examples are presented to further illustrate the invention, without unduly limiting the scope of this invention.

EXAMPLE

This example illustrates the treatment of a shale oil with aqueous solutions of polyacrylamide (PAA) for the removal of arsenic impurities. The shale oil used for the tests was a Paraho Western Shale Oil containing 31.6 ppm As, 60 ppm Fe, 3.0 ppm Ni, 1.1 ppm V, about 0.9 weight-% S and about 2.1 weight-% total N.

100 grams of the raw shale oil and 100 mL of an aqueous Betz Hi-Vis solution (viscosity: 10.1 centiPoise at 120° F.; marketed by Betz Laboratories, Inc.; Trevose, PA) containing about 500 ppmw of polyacrylamide having an approximate molecular weight of about $1\times10^7$–$1.5\times10^7$ and a degree of hydrolysis of about 25–30%. This mixture was stirred by means of a magnetic stirrer for about 2 hours at 77° C. The cooled mixture was then poured into a separatory funnel. The heavy aqueous phase was discarded, and the oil phase was submitted for analyses. Fe and As were determined by atomic absorption analysis, S content was determined by X-ray fluorescence spectrometry, and N content was measured in accordance with ASTM D3228.

The above described test was repeated with 100 g shale oil and 100 mL of an aqueous Betz Hi-Vis solution containing 1,600 ppm polyacrylamide and having a viscosity of 42.3 centiPoise at 120° F. Analysis results for the product of both runs are summarized in Table I.

TABLE I

| | Feed | Run 1 (500 ppm PAA) | Run 2 (1600 PAA) |
|---|---|---|---|
| As (ppm) | 31.6 | 4.4 | 11.2 |
| Fe (ppm) | 60 | 62.0 | 59.5 |
| S (wt %) | 0.9 | 0.80 | 0.76 |
| N (wt %) | 2.1 | 2.07 | 1.93 |

Data in Table I indicate that about 86% As (run 1) and 65% As (run 2), respectively, were removed from the shale oil feed by the treatment with aqueous polyacrylamide solutions at a low temperature of about 77° C.

I claim:

1. A process for removing at least a portion of arsenic impurities from a hydrocarbon-containing feed stream, which contains arsenic compounds, comprising the step (a) of contacting said feed stream with an aqueous extractant, which contains at least one substantially dissolved polyacrylamide, under suitable dearsenating conditions so as to produce a hydrocarbon-containing stream having a reduced level of arsenic.

2. A process in accordance with claim 1 wherein said hydrocarbon-containing feed stream is shale oil.

3. A process in accordance with claim 1 wherein said aqueous extractant contains at least one substantially dissolved polyacrylamide at a concentration ranging from about 5 ppmw to about 5000 ppmw.

4. A process in accordance with claim 3 wherein the weight ratio of the substantially dissolved polyacrylamide to the hydrocarbon-containing feed stream ranges from about 0.05:1 to about 20:1.

5. A process in accordance with claim 4 wherein said hydrocarbon-containing feed stream is shale oil.

6. A process in accordance with claim 3 wherein said substantially dissolved polyacrylamide has a molecular weight ranging from about $1\times10^3$ to about $1\times10^8$ and a degree of hydrolysis of about 0% to 50%.

7. A process in accordance with claim 6 wherein the weight ratio of the substantially dissolved polyacrylamide to the hydrocarbon-containing feed stream ranges from about 0.05:1 to about 20:1.

8. A process in accordance with claim 7 wherein said weight ratio ranges from about 0.1:1 to about 2:1.

9. A process in accordance with claim 7 wherein the hydrocarbon-containing feed stream is shale oil.

10. A process in accordance with the process of claim 8 wherein the hydrocarbon-containing feed stream is shale oil, and wherein the polyacrylamide has a molecular weight ranging from about $2\times10^6$ to about $2\times10^7$ and having a degree of hydrolysis ranging from about 10% to about 40%.

11. A process in accordance with claim 7 wherein the reaction time ranges from about 0.05 to about 50 hours, and the reaction temperature ranges from about 10° C. to about 200° C.

12. A process in accordance with claim 10 wherein the reaction time ranges from about 0.05 to about 50 hours, and the reaction temperature ranges from about 10° C. to about 200° C.

13. A process in accordance with claim 11 wherein the reaction time ranges from about 0.1 to about 5 hours, and the reaction temperature ranges from about 20° C. to about 90° C.

14. A process in accordance with claim 12 wherein the reaction time ranges from about 0.1 to about 5 hours, and the reaction temperature ranges from about 20° C. to about 90° C.

15. A process in accordance with claim 1 comprising the additional step (b) of separating the hydrocarbon-containing stream having a reduced level of arsenic from the aqueous extractant.

16. A process in accordance with claim 2 comprising the additional step (b) of separating the hydrocarbon-containing stream having a reduced level of arsenic from the aqueous extractant.

17. A process in accordance with claim 16 wherein said separating step comprises settling and decanting.

18. A process in accordance with claim 16 wherein the hydrocarbon-containing stream having a reduced level of arsenic contains sulfur and nitrogen impurities.

19. A process in accordance with claim 18 comprising the additional step (c) of catalytically hydrotreating the hydrocarbon-containing stream having a reduced level of arsenic so as to remove at least a portion of sulfur and nitrogen impurities.

20. A process for reducing the arsenic content of an arsenic containing hydrocarbon feed stream, said process comprising:

(a) contacting said feed stream with an aqueous extractant, which contains at least on substantially dissolved polyacrylamide, to form a two-phase liquid mixture, (b) separating said two-phase liquid mixture first into a hydrocarbon material having reduced arsenic content (as compared to said hydrocarbon feed stream) and an aqueous stream, and then (c) recovering said hydrocarbon material having a reduced arsenic content.

21. A process in accordance with claim 20 comprising the additional step of (d) subjecting said hydrocarbon material having a reduced arsenic content to heating under cracking conditions so as to produce gasoline and other useful fuel products.

* * * * *